US005953712A

United States Patent [19]

Herbert

[11] Patent Number: 5,953,712

[45] Date of Patent: Sep. 14, 1999

[54] MAIL FRANKING APPARATUS

[75] Inventor: Raymond John Herbert, Leigh-on-Sea, United Kingdom

[73] Assignee: Neopost Limited, Essex, United Kingdom

[21] Appl. No.: 08/792,430

[22] Filed: Jan. 30, 1997

[30] Foreign Application Priority Data

Jan. 31, 1996 [GB] United Kingdom ..... 9601937

[51] Int. Cl.[6] ..... G07B 17/02

[52] U.S. Cl. ..... 705/401; 360/133

[58] Field of Search ..... 235/492, 493; 360/132, 133, 137; 705/401

[56] References Cited

U.S. PATENT DOCUMENTS

| | | | |
|---|---|---|---|
| 4,809,185 | 2/1989 | Talmadge | 705/403 |
| 5,159,182 | 10/1992 | Eisele | 235/492 |
| 5,257,197 | 10/1993 | Gunther et al. | 364/464.02 |
| 5,338,923 | 8/1994 | Grieu | 235/492 |
| 5,471,038 | 11/1995 | Eisele et al. | 235/380 |
| 5,586,036 | 12/1996 | Pintsov | 705/408 |

FOREIGN PATENT DOCUMENTS

93/00658 1/1993 WIPO .

*Primary Examiner*—Edward R. Cosimano
*Attorney, Agent, or Firm*—Shoemaker and Mattare, Ltd.

[57] ABSTRACT

Apparatus for franking mail items is disclosed. The apparatus comprises a computer with a diskette drive for receiving magnetic diskettes for the recording of data therein and a device having the external shape and form of a magnetic diskette located in the diskette drive in place of a magnetic diskette. The device includes an interface magnetically coupled to a magnetic head of the diskette drive and includes a processor and memory for carrying out accounting functions and storing critical accounting data respectively. A printer is connected to the processor.

10 Claims, 2 Drawing Sheets

MAIL FRANKING APPARATUS

BACKGROUND OF THE INVENTION

This invention relates to the franking of mail items by accounting for postage charges in respect of those items and printing an impression on each item to indicate that a postage charge has been levied. In particular it relates to the use a general purpose computer in combination with secure means for carrying out franking of mail items.

It is known to use postage meters to print franking impressions on mail items to indicate that the postage charges for those items have been accounted for. Known postage meters are designed specifically to carry out functions required in respect of franking mail items. Current electronic postage meters include electronic circuits to carry out accounting and control functions and printing means operated by the electronic circuits to print postage information on mail items. The electronic circuits include memories to store accounting data, the memories generally include a descending register to store a value of credit available for use in franking mail items, an ascending register for storing an accumulated value of postage charge used by the postage meter in franking mail items and an items register for storing a count of the number of mail items on which postage data has been printed by the postage meter in franking those items. The memories are non-volatile so that in the event of interruption of the supply of power to the postage meter, due for example to a fault or power down of the postage meter, the accounting data is retained and not lost.

In order to provide verifiable storage of the accounting data, it has been customary to provide a plurality of replications of the registers in the memories and for example usually two separate memory devices are provided and two of each register is provided in each memory device. Thus in the event of a fault occurring in one of the registers resulting in corruption of data stored in that register, the data can be ascertained from the other copies of that register. During operation of the postage meter in carrying out a franking operation, the accounting circuits check that the data content of all replications of each register are in agreement and, in the event that the data in any replication of a register is inconsistent with data in other replications of that register, the accounting circuits cause inhibition of use of the postage meter for franking operations. Continued use of the postage meter is possible only after examination and correction of the data by an authorised person.

SUMMARIES OF THE INVENTION

According to one aspect of the invention mail franking apparatus comprises a computer including a diskette drive for receiving magnetic diskettes for the recording of data therein; a device having the external shape and form of a magnetic diskette located in the diskette drive in place of a magnetic diskette; interface means on the device magnetically coupled to a magnetic head of the diskette drive for reading data from and writing data to magnetic diskettes; said device including processing means and memory means and printing means connected to said processing means.

According to a second aspect of the invention mail franking apparatus for use with a computer includes a diskette drive for receiving magnetic diskettes for the recording of data therein; said apparatus including a device having the external shape and form of a magnetic diskette for location in the diskette drive in place of a magnetic diskette; interface means on the device magnetically coupled to a magnetic head of the diskette drive for reading data from and writing data to magnetic diskettes; said device including processing means and memory means and printing means connected to said processing means.

BRIEF DESCRIPTION OF THE DRAWING

Embodiments of the invention will now be described with reference by way of example to the drawings in which.

DESCRIPTION OF THE PREFERRED EMBODIMENT

Figure 1:
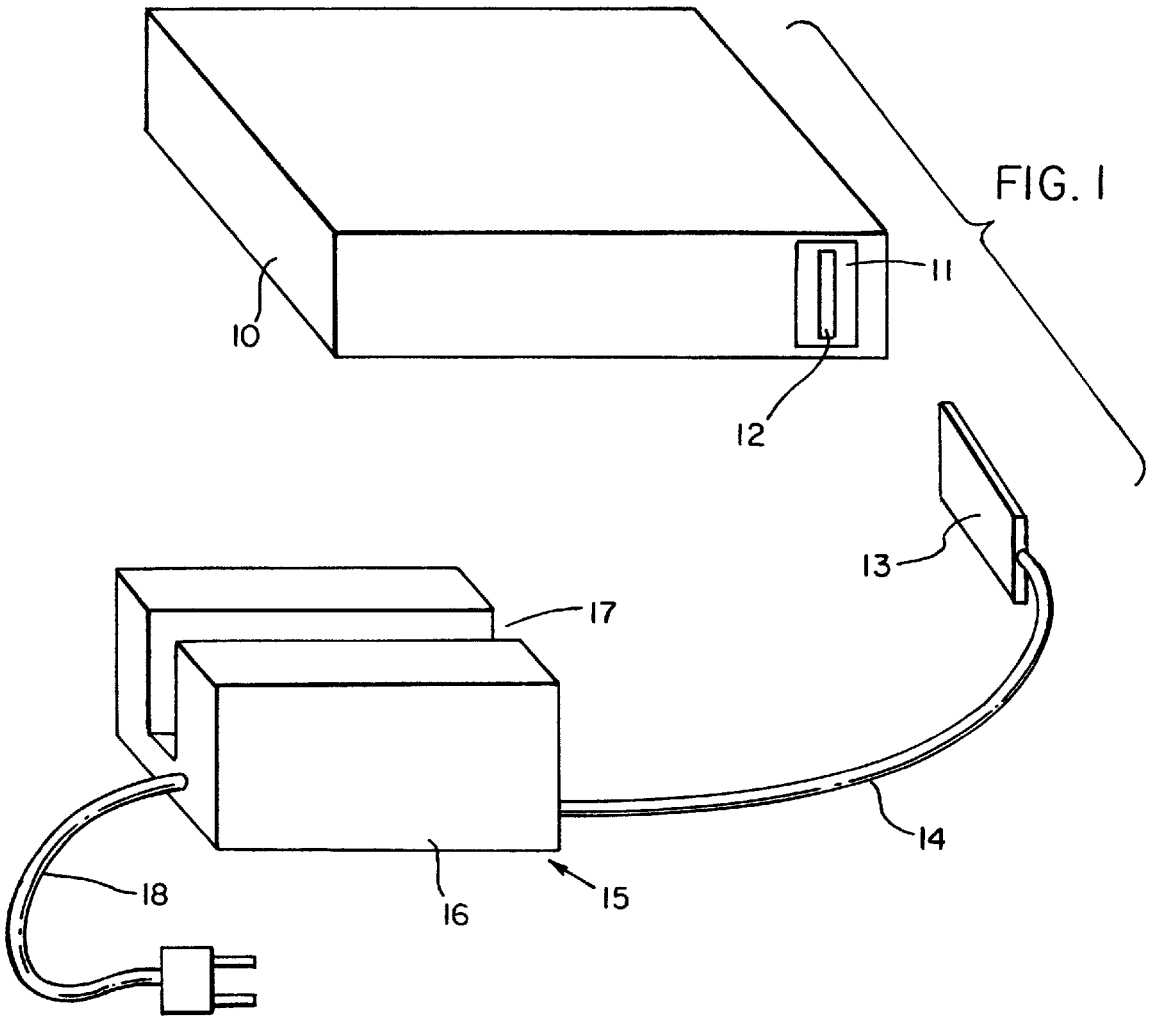
FIG. 1 is a perspective view of a personal computer and a secure unit for use in combination with the personal computer together with a mail printer connected to the secure unit.

Referring first to FIG. 1, a personal computer unit 10 includes a floppy diskette drive 11 and as is well known in the computer art, the diskette drive has a slot 12 for the reception of removable diskettes. Such diskettes include a disc of magnetisable material which is rotatable by a drive motor of the diskette drive 11 when the diskette is located in the slot 12. Diskettes are used for storing data output by data processing circuits of the computer, the data being recorded by magnetisation of areas of the disc while the disc is rotated by the drive motor. The data is recorded in a plurality of concentric circular tracks on the disc. Data recorded on the disc may be read from the disc and input to the data processing circuits of the computer. Reading and writing of data from and to the magnetic disc is accomplished by means of a magnetic read/write head mounted in the diskette drive and movable radially relative to the magnetic disc to enable alignment of the head with a selected one of the tracks. The magnetic head is so located as to be magnetically coupled with the magnetic material of the disc whereby appropriate energisation of the head creates a magnetic field capable of magnetising areas of the disc with a desired orientation of the magnetisation to represent data being recorded during rotation of the disc relative to the head. The magnetic coupling of the head and magnetic material results in induction of electric current in the head in response to magnetise areas of the material passing the head during rotation of the disc whereby data recorded as magnetised areas of the disc can be read from the disc.

Devices known as smartdisks are known and are described in International Patent specification number WO 93/00658. These devices comprise an outer housing which is identical in shape and form to casings used to contain and protect the magnetic discs of diskettes. Accordingly, outwardly the device appears indistinguishable from magnetic diskettes and the device can be inserted into and received in the slot of a standard diskette drive. However instead of a disc of magnetic material within the housing, the device contains electronic circuits and interface means for magnetic coupling with the read/write head of the diskette drive. The device does not include any means for mechanically coupling to the drive motor of the diskette drive and there is no rotatable element within the housing. Communication between the electronic circuits of the smartdisk devices described in WO 93/00658 is solely by means of magnetic coupling between the interface means of the device and the magnetic read/write head of the diskette drive. The housing is provided with an access aperture to permit magnetic coupling between the read/write head and the circuits of the device. This aperture is the same as that provided in the casing of diskettes and preferably includes a retractable cover as in diskettes.

The present invention proposes the provision of a mail franking device for use in combination with a general purpose computer, such as a personal computer. The franking device comprises a smartdisk device 13 connected, by means of an electrical connection 14, directly to a mail printer 15. The printer is a digital printer and may for example use ink jet or thermal printing technologies. The printer includes a housing 16 containing the elements required for printing on mail items and the housing has a slot 17 along which mail items are passed to receive an imprint by means of a print head of the printer. The printer may include means to feed the mail item along the slot past the print head or the mail item may be moved manually along the slot and sensing means is provided to sense movement of the mail item to control the print head to operate in synchronism with movement of the mail item. Electrical power required for operation of the printer 15 is provided from a mains power supply by means of electrical power connection 18.

When it is desired to frank a mail item, the device 13 is inserted into the slot 12 of the diskette drive 11 so that the electronic circuits of the device 13 are in communication, by means of the interface and magnetic coupling thereof with the read/write head, with data processing circuits of the computer. Operation of the device 13 is under the control of the personal computer.

Figure 2:
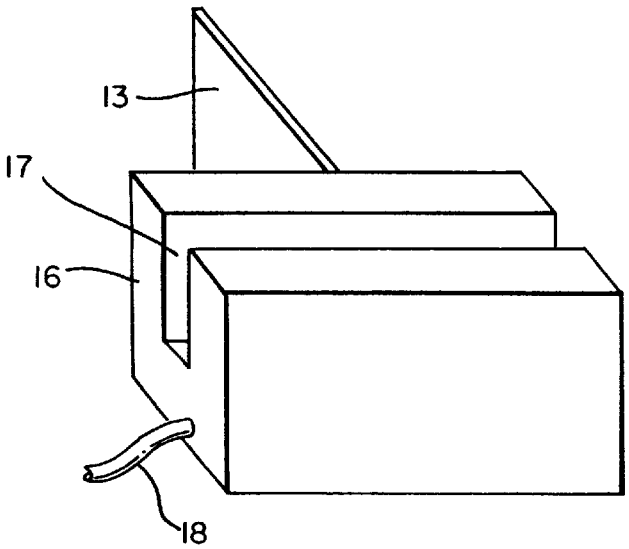
FIG. 2 is a perspective view of a personal computer and an integrally constructed secure unit and mail printer for use in combination with the personal computer.

In a modification of the mail franking device, shown in FIG. 2, the printer 15 and device 13 are constructed as an integral unit. Accordingly when the device 13 is inserted in the slot 12 of the diskette drive 11, the printer is supported by and projects from the personal computer 10.

Figure 3:
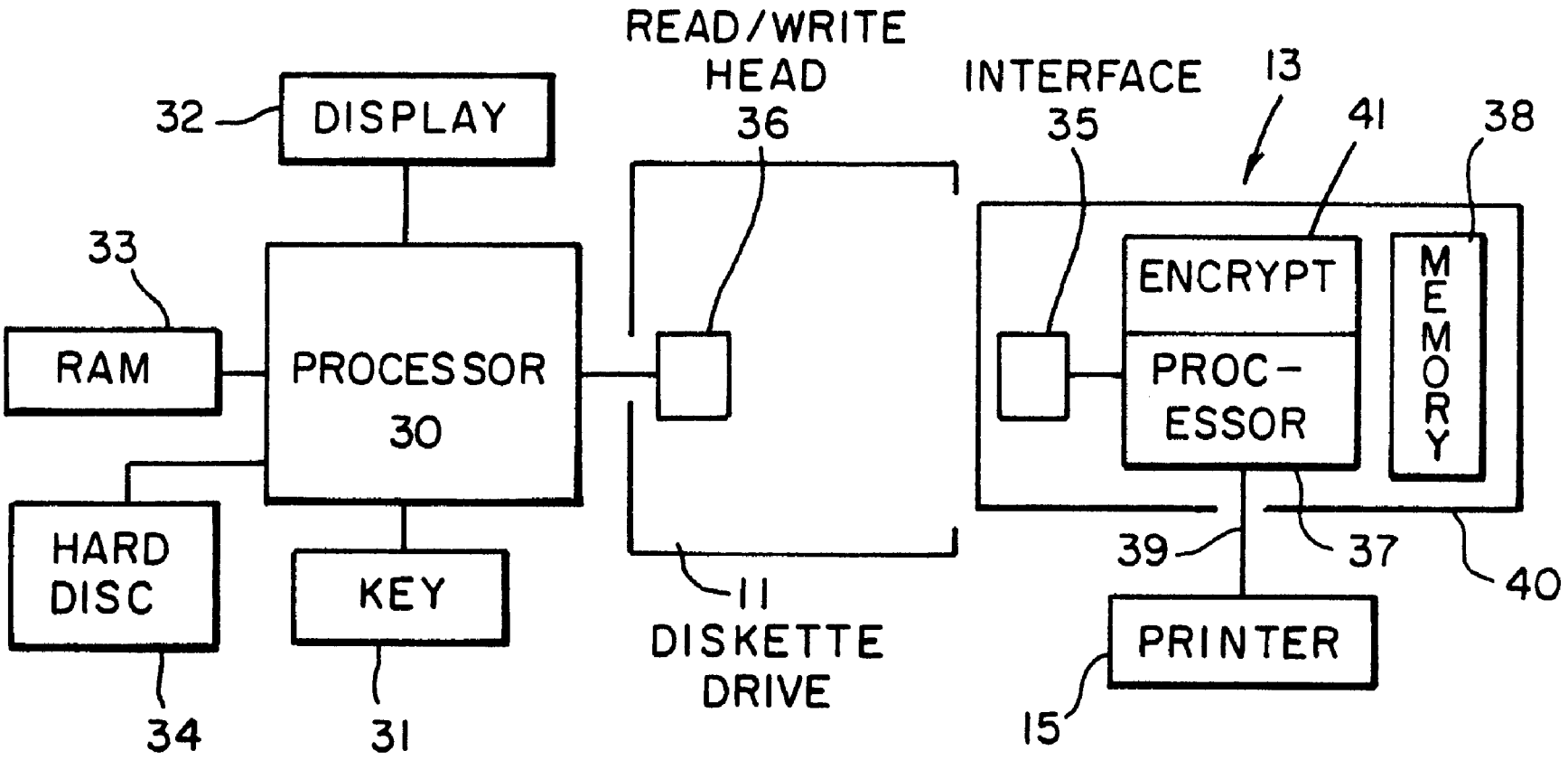
FIG. 3 is a block diagram of a personal computer, secure unit and mail printer.

Referring now to FIG. 3, the personal computer includes data processing circuits 30 operating under program routines, a keyboard 31 for the input of commands and data and a display monitor 32 to display to a user of the computer input on the keyboard and data and messages relating to operation of the computer. The messages may include prompts to the user for input of data on the keyboard and for feeding of mail item along the slot of the mail printer. The personal computer also includes random access memory (RAM) 33 for temporary storage of data during operation of the computer, a hard disc drive 34 for non-volatile storage of data and the floppy diskette drive 11.

The smartdisk device 13 is insertable into the diskette drive 11 to be located therein such that an interface 35 is magnetically coupled with a magnetic read/write head 36. The interface 35 is connected to processing circuits 37 and memory circuits 38 in the device 13 to enable data to be input to the circuits 37 from the computer and to be output from the circuits 37 to the computer. The circuits 37 are also connected by electrical connections 39 to circuits in the mail printer 15 for controlling operation of the print head of the mail printer.

The housing 40 of the device 13 is sealed and provides security against unauthorised access to electronic components of the device contained in the housing. All functions in a franking operation required to be effected in a secure manner are carried out by the processing circuits 37 of the device 13. These functions include accounting in respect of value dispensed in franking mail items and the generation of signals to control operation of the print head to print franking impression on mail items in which the franking impressions include an indication of the postage charge for the item. Data, and in particular secure accounting data relating to use in respect of franking mail items is stored in the memory circuits of the device 13. Other functions carried out by the processing circuits include control of means to feed the mail item through the slot of the printer, responding to sensors detecting movement of the mail item. The memory circuits of the device 13 store a value of credit available for use in franking mail items and resetting credit value in a recrediting operation is performed by the processing circuits 37.

The device 13 is operated under the control of the personal computer 10 and the computer 10 acts as a user interface. The computer also serves to carry out non-secure functions and may store in its memory devices 33, 34 data which it is not required to maintain secure. If desired the circuits 37 of the device 13 may include means 41 for encrypting data whereby data to be maintained secure can be encrypted prior to writing to memory. If the data is encrypted, the hard disc 34 of the computer may be used to store some or all of the data required to be maintained secure.

I claim:

1. Mail franking apparatus comprising a computer including:

a diskette drive for receiving magnetic diskettes for the recording of data therein, said diskette drive including a magnetic read/write head for reading data from and writing data to magnetic diskettes; and postage dispensing means;

said postage dispensing means including:

a device insertable into the diskette drive in place of a magnetic diskette;

and printing means;

said device including:

interface means magnetically coupled to said magnetic read/write head when said device is located in said diskette drive;

processing means connected to said interface means;

memory means for storing accounting data and connected to said processing means and said printing means being connected to said processing means;

said processing means being operable to receive input data from the computer via the interface magnetically coupled to the read/write head, to carry out accounting functions in respect of postage value dispensed and of accounting data stored in said memory means and to operate the printing means to print a franking impression indicative of the postage value dispensed.

2. Mail franking apparatus as claimed in claim 1 wherein the printing means is physically separate from the postal device and including an electrical cable connecting the processing means of the postal device to said printing means.

3. Mail franking apparatus as claimed in claim 1 wherein the postal device and the printing means are constructed as an integral unit.

4. Mail franking apparatus as claimed in claim 1 wherein the postal device includes a secure housing and the processing means and the memory means are contained within the secure housing.

5. Mail franking apparatus as claimed in claim 1 wherein the processing means includes encryption means operable to encrypt data processed by the processing means.

6. Mail franking apparatus for use with a computer including a diskette drive for receiving magnetic diskettes for the recording of data therein, said diskette drive including a magnetic read/write head for reading data from and writing data to magnetic diskettes; said mail franking apparatus including:

a device insertable into the diskette drive in place of a magnetic diskette; and printing means;

said device including:

interface means located on the device to be magnetically coupled to said magnetic read/write head when the device is inserted into the diskette drive for communication of data between said computer and said device;

processing means connected to said interface;

memory means connected to said processing means: and said printing means being connected to said processing means; and said processing means being operable to receive data from the computer via the interface when the device is inserted into the diskette drive of the computer and the interface is magnetically coupled to the read/write head, to carry out accounting functions in respect of postage value dispensed and of accounting data stored in said memory means and to operate the printing means to print a franking impression indicative of the postage value dispensed.

7. Mail franking apparatus as claimed in claim 6 wherein the printing means is physically separate from the postal device and including an electrical cable connecting the processing means of the postal device to said printing means.

8. Mail franking apparatus as claimed in claim 6 wherein the postal device and the printing means are constructed as an integral unit.

9. Mail franking apparatus as claimed in claim 6 wherein the postal device includes a secure housing and the processing means and the memory means are contained within the secure housing.

10. Mail franking apparatus as claimed in claim 6 wherein the processing means includes encryption means operable to encrypt data processed by the processing means.

* * * * *